US006799918B1

(12) United States Patent
Scolnik

(10) Patent No.: US 6,799,918 B1
(45) Date of Patent: Oct. 5, 2004

(54) SELECTING WEIGHT AND BALANCE IN WRITING IMPLEMENTS

(76) Inventor: William L. Scolnik, 55 Long Hill Rd., Oakland, NJ (US) 07436

( * ) Notice: Subject to any disclaimer, the term of this patent is extended or adjusted under 35 U.S.C. 154(b) by 0 days.

(21) Appl. No.: 10/665,050

(22) Filed: Sep. 16, 2003

(51) Int. Cl.[7] ..... B43K 29/00
(52) U.S. Cl. ..... 401/195; 401/48; 401/104
(58) Field of Search ..... 401/195, 52, 104, 401/48, 95; 24/11 HC, 11 P, 11 R, 11 S

(56) References Cited

U.S. PATENT DOCUMENTS 2,029,767 A 2/1936 Eisenhauer
2,557,710 A * 6/1951 Wade et al. ..... 24/11 P
3,638,280 A 2/1972 Di Spirito
4,168,129 A 9/1979 Herrnring
4,176,979 A 12/1979 Saida
4,377,349 A 3/1983 Kunii
4,479,732 A 10/1984 Shimizu
4,837,900 A 6/1989 Boyce et al.
5,354,141 A * 10/1994 Watanabe ..... 401/65
5,564,850 A 10/1996 Nagaoka
5,898,427 A 4/1999 Okamoto

* cited by examiner

*Primary Examiner*—Gregory L. Huson
*Assistant Examiner*—Huyen Le
(74) *Attorney, Agent, or Firm*—Arthur Jacob

(57) ABSTRACT

A writing implement is balanced in accordance with the requirements of a particular individual user by a weight selectively movable along the writing implement to locate the center of gravity of the writing implement at a selected position relative to a grip by which the writing implement is gripped by the user during the execution of writing movements of the writing implement. A clip member retains the writing implement, when not in use, on a support with a gripping force adjustable to accommodate the structural characteristics of the support. A protective cover member is placed over the writing point of the writing implement when not in use and, during use, is retained at the end of the writing implement opposite the writing point by a magnet. The weight is visible through a transparent portion of the writing implement for aesthetic purposes as well as for visually determining the position of the weight relative to the grip.

15 Claims, 2 Drawing Sheets

SELECTING WEIGHT AND BALANCE IN WRITING IMPLEMENTS

The present invention relates generally to writing implements and pertains, more specifically, to writing implements and method providing improved ergonomics, especially in achieving a selected weight and balance for writing ease, comfort and accuracy.

Writing implements currently in use are designed with little or no attention paid to ergonomics and, in particular, to tailoring the weight and balance of a writing implement to the particular requirements of an individual user of the writing implement. A pen which is too heavy or too light, for example, or which does not afford the individual with a balance appropriate to the manner in which that individual grips and manipulates the pen, affects not only the accuracy and appearance of the writing, but very quickly leads to discomfort and fatigue.

In addition, currently available writing implements which employ a protective cover for the writing point generally utilize covers which are relatively cumbersome and weighty. While these covers do accomplish adequate protection of a writing point when the implement is not being used for writing, placement of such a cover on a writing implement when configured for writing usually upsets the weight and balance of the implement, as well as interferes with the grip of the implement in the hand of the user.

Further, clips incorporated into writing implements for retaining these implements in pockets and the like, when the implement is not in use, seldom take into consideration the diversity in the structural characteristics existing at these retention locations. For example, clips designed for optimum retention of a pen in a shirt pocket will resist accepting a bulkier material, such as that found at a jacket pocket. The result often is a compromise design with concomitant compromised performance.

The present invention provides improvements which alleviate the problems outlined above. As such, the present invention attains several objects and advantages, some of which are summarized as follows: Provides a writing implement with the ability to tailor weight and balance to the preferences of individual users of the writing implement; enables the use of a writing implement with greater ease and comfort, and with reduced fatigue; promotes writing accuracy with less effort; affords increased convenience of storage, without affecting ergonomics in use; enables selective adjustment for optimum securement at various support locations where a writing implement usually is carried when not in use; provides an aesthetically attractive writing implement, readily customized in appearance to the requirements of a particular individual user, including an attractive feature for displaying the identify of the owner of the writing implement; provides advanced ergonomic features in a writing implement having a rugged construction capable of versatile and exemplary performance over an extended service life.

The above objects and advantages, as well as further objects and advantages, are attained by the present invention which may be described briefly as an improvement in a writing implement for the execution of writing movements by manual manipulation in a hand of an individual, the improvement enabling selective balancing of the writing implement in the hand of the individual executing the writing movements, the improvement comprising: an elongate barrel extending longitudinally between opposite first and second ends; a grip associated with the barrel for being gripped by the hand of the individual during execution of the writing movements; a writing point adjacent the first end of the barrel; a center of gravity located between the first and second ends of the barrel; and a weight associated with the barrel for selective movement in longitudinal directions relative to the writing point to place the center of gravity at a selected position relative to the grip, the selected position establishing a balance suited to the hand of the individual manipulating the writing implement during writing movements.

In addition, the present invention includes a method for improving writing with a writing implement having a center of gravity and a grip to be held in a hand of an individual for manual manipulation of the writing implement through writing movements, the method comprising: providing the writing implement with a weight selectively movable relative to the grip; and moving the weight relative to the grip to move the center of gravity of the writing implement to a selected position relative to the grip to establish a balance suited to the hand of the individual manipulating the writing implement during writing movements.

The invention will be understood more fully, while still further objects and advantages will become apparent, in the following detailed description of preferred embodiments of the invention illustrated in the accompanying drawing, in which.

Figure 1:
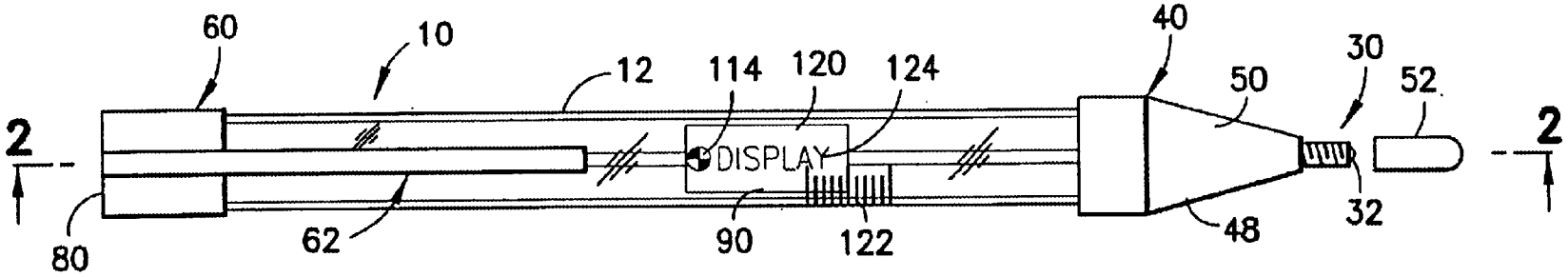
FIG. 1 is a plan view of a writing implement constructed in accordance with the present invention, shown with a cover member removed.
Figures 2, 3:
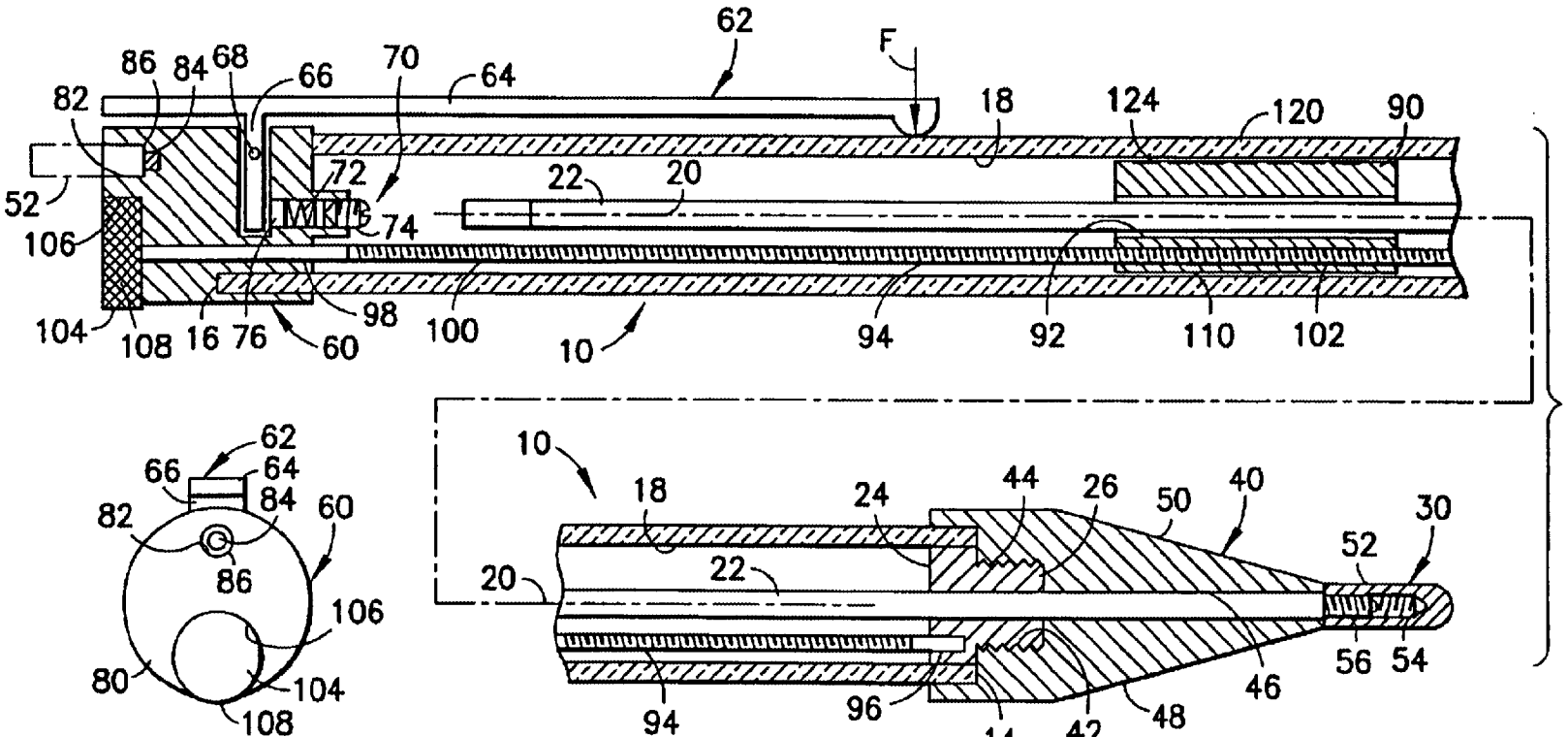
FIG. 2 is an enlarged longitudinal cross-sectional view taken along line 2—2 of FIG. 1, with the cover member in place.
FIG. 3 is an end elevational view of the left end of FIG. 2.

Referring now to the drawing, and especially to FIGS. 1 and 2 thereof, a writing implement constructed in accordance with the present invention is shown in the form of a writing pen 10 having an elongate barrel 12 extending longitudinally between a first end 14 and an opposite second end 16. A longitudinal bore 18 extends through the barrel 12, along a longitudinal central axis 20, between the first and second ends 14 and 16.

A writing cartridge 22 is placed within the bore 16 and is secured within the barrel 12 by a plug 24 affixed to the barrel 12 adjacent the first end 14, the cartridge 22 extending through the plug 24 and being secured by a tight fit within a sleeve portion 26 of the plug 24. Cartridge 22 includes a writing point 30 which, in the illustrated embodiment, comprises a writing ball 32 in a manner now well known in the construction of ball-point pens.

A writing tip 40 is coupled to the barrel 12, adjacent the first end 14, by means of a selectively releasable coupling arrangement, shown in the form of screw-threaded recess 42 in the writing tip 40 which engages a complementary screw thread 44 carried by the sleeve portion 26 of plug 24, the writing tip 40 including an internal passage 46 through which the cartridge 22 extends. An external surface 48 extends along the writing tip 40 and provides a grip in the form of finger-grip 50 by which the pen 10 is gripped by a user's hand during writing movements of the pen 10. A cover member 52 selectively is placed over the writing point 30 and includes an internal recess 54 dimensioned to fit over the writing point 30 for seating on the writing cartridge 22. Recess 54 preferably is threaded to engage a complementary thread 56 adjacent writing point 30 for maintaining the cover member 52 in place over the writing point 30 to protect the writing point 30 when the pen 10 is not in use.

Turning now to FIG. 3, as well as to FIGS. 1 and 2, cap member 60 is affixed to the barrel 12 adjacent the second end 16, as by a light press fit which secures the cap member 60 to the barrel 12 and enables selective removal of the cap member 60, for purposes to be described below. Cap member 60 carries a pocket clip 62 which includes a clip member 64 extending along the barrel 12, essentially parallel to axis 20, and biased toward the barrel 12 by a biasing arrangement for the purpose of establishing a gripping force capable of gripping a support structure, such as the edge of a pocket within which the pen 10 may be carried, in a manner well known in the construction of writing implements. The biasing arrangement includes an arm 66 integral with the clip member 64, extending laterally into the cap member 60, and mounted in the cap member 60 for pivotal movement about a pin 68 which secures the clip member 64 within the cap member 60. An adjustable biasing mechanism 70 is mounted in the cap member 60 and is coupled to the arm 66 for biasing the clip member 64 toward the barrel 12 with a biasing force F, the magnitude of which force F is determined by adjustment of the biasing mechanism 70.

The biasing mechanism 70 enables selective adjustment of the magnitude of force F so that the user of the pen 10 is able to adjust the gripping force exerted by the clip member 64 on the support structure to which the pen 10 is to be clipped. In the illustrated embodiment, the biasing force F is established by a biasing member in the form of a helical spring 72 which extends between arm 66 and an adjustment screw 74 threaded into cap member 60. Upon selective removal of cap member 60 from barrel 12, access is gained to adjustment screw 74 for advancing or retracting the adjustment screw 74 to increase or decrease the force exerted by helical spring 72 upon the arm 66, through a plunger 76 interposed between helical spring 72 and arm 66, and, consequently, the biasing force F. In this manner the gripping force applied by the clip member 64 where the clip member 64 engages a support structure selectively is varied to accommodate the characteristics of a particular support structure. For example, where the support structure comprises a thin material such as that present at a shirt pocket, the biasing force F is adjusted to accept the thin material. Should the user wish to use a pocket protector, or secure the pen 10 in a jacket pocket, the biasing force F can be adjusted to an optimum for the thicker material found at these support structures. Alternately, cap member 60 may be secured more firmly to second end 16 of barrel 12 and access to adjustment screw 74 may be gained, with cap member 60 in place at end 16 of barrel 12, by removing writing tip 40 and writing cartridge 22 and then inserting an elongate screw driver (not shown) through plug 24 to reach adjustment screw 74.

Cap member 60 includes an end face 80, and a relatively small well 82 extends into cap member 60 from end face 80. A small magnet 84 is seated at the bottom 86 of the well 82, and the well 82 is configured to receive the protective cover member 52 when the cover member 52 is not in place over the writing point 30. The protective cover member 52 is constructed of a magnetically-attracted material, such as steel, so that upon placement of the cover member 52 in the well 82, the cover member 52 is retained in the well 82 by magnetic attraction, as illustrated in phantom in FIG. 2. Cover member 52 is relatively small, enabling unobtrusive storage in well 82 when the cover member 52 is not in use, with little weight added adjacent the second end 16 of barrel 12.

Pen 10 includes an improvement which enables a user of the pen 10 to tailor the weight and balance of the pen 10 to the requirements of a particular user. By selecting a weight and balance appropriate to the user, writing movements can be executed with greater accuracy, with less effort and with reduced fatigue. To this end, a weight 90 is placed within the bore 18 of barrel 12 of the pen 10. The relative dimensions of the weight 90 and the bore 18 enable the weight 90 to slide longitudinally along the bore 18, between the first and second ends 14 and 16 of the barrel 12. A hole 92 passes longitudinally through the weight 90 and provides clearance for the cartridge 22 as the weight 90 moves along the bore 18.

In order selectively to adjust the location of the weight 90 longitudinally along the barrel 12, a lead screw 94 is journaled in plug 24, at 96, and is journaled in cap member 60, at 98, and carries a lead screw thread 100 which is engaged with a complementary lead screw thread 102 in the weight 90. An actuator in the form of a knob 104 is coupled with the lead screw 94 adjacent second end 16 of the barrel 12, the knob 104 being located in a generally complementary recess 106 in cap member 60. Knob 104 is knurled at 108 to facilitate actuation by rotation of the knob 104 and concomitant rotation of lead screw 94 to move weight 90 in longitudinal directions along the barrel 12. Weight 90 preferably includes a generally cylindrical outer surface 110 having a central axis coaxial with axis 20, and the lead screw 94 and complementary lead screw thread 102 are offset radially from the axis 20 so that the central axis of the cylindrical outer surface 110 and the axis 20 remain coaxial during translation of the weight 90 and the translation proceeds smoothly along the length of the bore 18.

The magnitude of the weight of pen 10 is varied by the selection of a weight 90 of desired magnitude. Any selected one of a number of available weights 90 is installed readily within the barrel 12 of pen 10 merely by removing cap member 60, engaging the selected cap member 60 with the lead screw 94 and then rotating the lead screw 94 to move the weight 90 along the bore 18. The balance of the pen 10 in the hand of a user is determined by the location of the center of gravity of the pen 10 relative to the grip provided by the finger-grip 50, and the longitudinal location of the center of gravity, in turn, is determined by the longitudinal position of weight 90 along the barrel 12. With the cap member 60 secured in place adjacent the second end 16 of the barrel 12, the knob 104 is rotated to move the weight 90 and, consequently, the center of gravity 114 of the pen 10, relative to the finger-grip 50, to attain a balance in accordance with the requirements of a particular user. Weight 90 preferably is constructed of a relatively heavy material, such as steel, in order to impart the desired weight characteristics to pen 10 without excessive bulk. Increased accuracy is assured through the employment of relatively fine lead screw threads 100 and 102, enabling concomitant fine adjustments of the longitudinal position of weight 90 and, consequently, center of gravity 114.

In order to enhance the aesthetic appearance of pen 10, at least a portion of the barrel 12, and preferably the entire barrel 12, is constructed of a transparent material, such as glass or a transparent synthetic polymeric material. The transparent material provides at least a window portion 120 juxtaposed with the weight 90 such that translation of the weight 90 can be observed, thereby providing a unique aesthetic feature. In addition, graduations 122 may be provided for determining the precise location of the weight 90 so as to facilitate the duplication of various positions for different writing characteristics. Thus, the ergonomics provided by pen 10 are selectively variable to suit the requirements of individual users. Moreover, the provision of a transparent window portion 120 enables the placement of a display 124 on the weight 90, with the display 124 being visible through the window portion 120. Such a display may include the user's name or other identification which will personalize the pen 10 in an aesthetically appealing manner.

Figure 4:
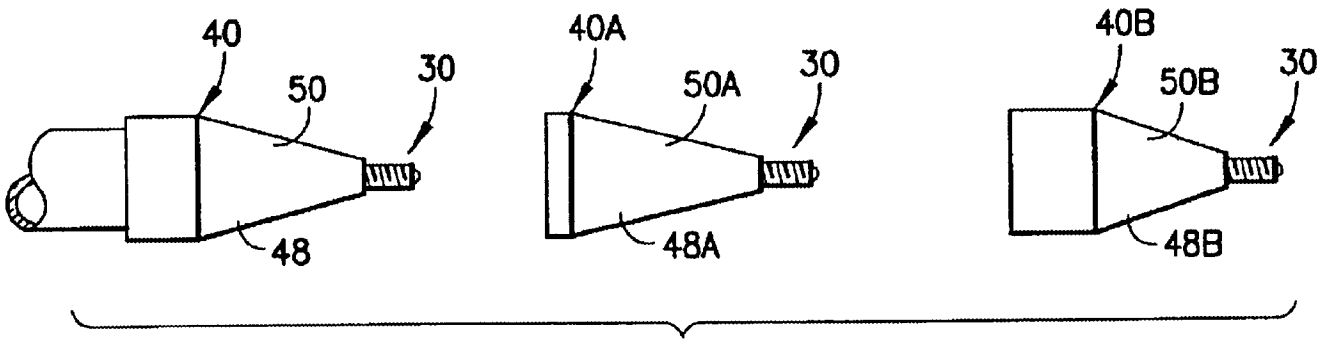
FIG. 4 is a fragmentary plan view of the right end, showing alternate component parts of the writing implement.

Referring now to FIG. 4, the configuration of the finger-grip 50 provided by the writing tip 40 can be changed to suit the requirements of a particular user by the selection of any one of several interchangeable writing tips 40. Thus, for example, while external surface 48 of writing tip 40 provides a frusto-conical configuration having a first predetermined taper suited to the grip of some users, alternate writing tips 40A and 40B provide corresponding external surfaces 48A and 48B with frusto-conical configurations having a more shallow taper and a more steep taper, respectively, so that selection of one of the writing tips 40, 40A or 40B enables a user to choose a finger-grip 50, 50A or 50B best suited to that user's requirements. Interchanging of writing tips 40, 40A and 40B is accomplished merely by uncoupling the threaded connection provided by the selectively releasable coupling arrangement at the sleeve portion 26 of plug 24 and coupling a selected writing tip 40, 40A or 40B to the barrel 12.

It will be seen that the present invention attains the several objects and advantages summarized above, namely; Provides a writing implement with the ability to tailor weight and balance to the preferences of individual users of the writing implement; enables the use of a writing implement with greater ease and comfort, and with reduced fatigue; promotes writing accuracy with less effort; affords increased convenience of storage, without affecting ergonomics in use; enables selective adjustment for optimum securement at various support locations where a writing implement usually is carried when not in use; provides an aesthetically attractive writing implement, readily customized in appearance to the requirements of a particular individual user, including an attractive feature for displaying the identify of the owner of the writing implement; provides advanced ergonomic features in a writing implement having a rugged construction capable of versatile and exemplary performance over an extended service life.

It is to be understood that the above detailed description of preferred embodiments of the invention is provided by way of example only. Various details of design and construction may be modified without departing from the true spirit and scope of the invention as set forth in the appended claims.

The embodiments of the invention in which an exclusive property or privilege is claimed are defined as follows:

1. An improvement in a writing implement for the execution of writing movements by manual manipulation when oriented for such writing movements in a hand of an individual, the improvement enabling selective balancing of the writing implement in the hand of the individual executing the writing movements, the improvement comprising;

an elongate barrel extending longitudinally between opposite first and second ends;

a grip associated with the barrel for being gripped by the hand of the individual during execution of the writing movements;

a writing point adjacent the first end of the barrel;

a center of gravity located between the first and second ends of the barrel;

a weight associated with the barrel for selective movement in longitudinal directions relative to the writing point among at least several locations available when the writing implement is oriented for writing movements; and a mechanism for placing the weight at a selected one of the several locations available when the writing implement in oriented for writing movements to place the center of gravity at a selected position relative to the grip and thereby establish a balance suited to the hand of the individual manipulating the writing implement during writing movements.

2. The improvement of claim 1 wherein the barrel includes a bore extending longitudinally along the barrel, and the weight is located in the bore for movement in longitudinal directions along the bore.

3. The improvement of claim 2 wherein the barrel includes at least a transparent portion, and the weight is juxtaposed with the transparent portion for enabling a visual observation of the position of the weight within the barrel.

4. The improvement of claim 3 wherein the weight includes a display visible through the transparent portion of the barrel.

5. The improvement of claim 1 wherein the grip is juxtaposed with the writing point.

6. The improvement of claim 5 wherein the grip is located on a writing tip, a coupling couples the writing tip with the first end of the barrel for selective attachment and detachment of the writing tip and the barrel, thereby enabling the attachment of a writing tip selected from a plurality of writing tips, each of which writing tips includes a grip having a configuration different from a grip of another of the writing tips, whereby a writing tip having a grip of a selected configuration is selectively coupled to the barrel.

7. The improvement of claim 1 including a cover member selectively placed over the writing point and selectively removed from over the writing point, the cover member including at least a portion of magnetically-attracted material, and a magnet located adjacent the second end of the barrel for retaining the cover member adjacent the second end of the barrel when the cover member is removed from the writing point.

8. The improvement of claim 7 wherein the barrel includes a well located adjacent the second end of the barrel, the well being configured for reception of the cover member within the well when the cover member is retained adjacent the second end of the barrel.

9. The improvement of claim 1 including a clip member located on the barrel for enabling attachment of the barrel to a support structure to be engaged by the clip member, the support structure having given structural characteristics, and a biasing arrangement for biasing the clip member with a biasing force establishing a gripping force between the clip member and the support structure, the biasing arrangement having a selectively adjustable mechanism for selectively adjusting the biasing force to enable the selection of a gripping force which accommodates the given structural characteristics of a particular support member.

10. The improvement of claim 9 wherein the biasing arrangement includes a spring for exerting the biasing force, and the adjustable mechanism is coupled with the spring for selectively changing the biasing force exerted by the spring.

11. The improvement of claim 1 wherein the writing implement is a pen and the writing point comprises a pen point.

12. An improvement in a writing implement for the execution of writing movements by manual manipulation in a hand of an individual, the improvement enabling individual executing the writing movements, the improvement comprising;

an elongate barrel extending longitudinally between opposite first and second ends;

a bore extending longitudinally along the barrel;

a grip associated with the barrel for being gripped by the hand of the individual during execution of the writing movements;

a writing point adjacent the first end of the barrel;

a center of gravity located between the first and second ends of the barrel; and a weight located in the bore of the barrel for selective movement in logitudinal directions along the bore relative to the writing point to place the center of gravity at a selected position relative to the grip, the selected position establishing a balance suited to the hand of the individual manipulating the writing implement during writing movements; and wherein the bore extends along a longitudinal axis, a lead screw extends within the bore, essentially parallel to the longitudinal axis, the lead screw being journaled for selective rotation within the bore, the weight is coupled to the lead screw for movement in longitudinal directions in response to rotation of the lead screw, and an actuator is coupled to the lead screw for selective actuation to rotate the lead screw.

13. The improvement of claim 12 wherein the actuator comprises a knob coupled to the lead screw for rotation of the lead screw in response to rotation of the knob.

14. A method for improving writing with a writing implement having a center of gravity and a grip to be held in a hand of an individual for manual manipulation of the writing implement through writing movements while oriented for such writing movements, the method comprising:

providing the writing implement with a weight selectively movable relative to the grip among at least several locations available when the writing implement is oriented for writing movements; and moving the weight relative to the grip to place the weight at a selected one of the several locations available when the writing implement is oriented for writing movements to move the center of gravity of the writing implement to a selected position relative to the grip and establish a balance suited to the hand of the individual manipulating the writing implement during writing movements.

15. The method of claim 14 wherein the writing implement extends in a longitudinal direction, and the weight is moved in longitudinal directions to establish the balance.

* * * * *